US009138366B2

(12) United States Patent
Radko

(10) Patent No.: US 9,138,366 B2
(45) Date of Patent: Sep. 22, 2015

(54) HYPERBARIC APPARATUS WITH STORAGE COMPARTMENT

(75) Inventor: John Radko, Irvine, CA (US)

(73) Assignee: ENVIRONMENTAL TECTONICS CORPORATION, Southampton, PA (US)

( * ) Notice: Subject to any disclaimer, the term of this patent is extended or adjusted under 35 U.S.C. 154(b) by 749 days.

(21) Appl. No.: 12/548,018

(22) Filed: Aug. 26, 2009

(65) Prior Publication Data

US 2011/0048424 A1 Mar. 3, 2011

(51) Int. Cl.

*A61G 10/00* (2006.01)
*A61G 10/02* (2006.01)
*A61G 1/013* (2006.01)

(52) U.S. Cl.

CPC ..... *A61G 10/026* (2013.01); *A61G 1/013* (2013.01)

(58) Field of Classification Search

CPC ..... A61G 10/026; A61G 7/00; A61G 7/002; A61G 7/012; A61G 7/08; A61G 7/1042; A61G 7/1046; A61G 1/013; B63C 11/32; B63C 11/325; A61M 16/10; A62B 31/00
USPC ..... 600/21, 22; 128/202.122, 205.26
See application file for complete search history.

(56) References Cited

U.S. PATENT DOCUMENTS 2,240,819 A * 5/1941 Banneitz ..... 128/205.26
3,754,551 A * 8/1973 Nielsen ..... 128/205.25
3,877,427 A * 4/1975 Alexeev et al. ..... 128/202.13
3,999,541 A * 12/1976 Tabor ..... 128/203.12
4,038,973 A * 8/1977 Moore ..... 600/22
4,224,936 A * 9/1980 Cox ..... 600/21
4,227,524 A * 10/1980 Galerne ..... 128/205.26
4,448,189 A * 5/1984 Lasley ..... 600/21
4,467,798 A * 8/1984 Saxon et al. ..... 128/205.26
4,727,870 A * 3/1988 Krasle ..... 128/202.12
4,750,474 A * 6/1988 Dukhan et al. ..... 600/22
4,936,824 A * 6/1990 Koch et al. ..... 600/22
5,006,105 A * 4/1991 Sherard ..... 600/22
5,083,558 A * 1/1992 Thomas et al. ..... 128/202.12
5,205,629 A * 4/1993 Simons ..... 312/249.9
5,255,673 A * 10/1993 Cardwell et al. ..... 128/202.12
5,283,919 A * 2/1994 Grant ..... 5/620
5,319,817 A * 6/1994 Hay et al. ..... 5/611
5,327,904 A * 7/1994 Hannum ..... 128/205.26

(Continued)

FOREIGN PATENT DOCUMENTS

WO WO 9912507 A1 * 3/1999

OTHER PUBLICATIONS

Bara-Med® product line brochures.*

*Primary Examiner* — Lynne Anderson
*Assistant Examiner* — Kathryn E Ditmer
(74) *Attorney, Agent, or Firm* — Robert R. Axenfeld

(57) ABSTRACT

A hyperbaric apparatus with storage compartment is provided comprising a chamber for housing a patient and administration of hyperbaric therapy, a moveable patient support platform for receiving the patient and for transferring the patient into and/or out of the chamber, and a base comprising a storage compartment for stowing a patient transport device. The storage compartment conveniently stows the patient transport device, excluding it from the space surrounding the hyperbaric chamber, thereby freeing-up floor space surrounding the hyperbaric treatment area, while keeping the transport device close-at-hand for removal of the patient upon the conclusion of hyperbaric treatment.

3 Claims, 4 Drawing Sheets

(56) References Cited

U.S. PATENT DOCUMENTS

| | | | | |
|---|---|---|---|---|
| 5,335,651 | A * | 8/1994 | Foster et al. | 128/202.13 |
| 5,402,775 | A * | 4/1995 | Reneau | 128/202.12 |
| 5,446,934 | A * | 9/1995 | Frazier | 5/655 |
| 5,454,368 | A * | 10/1995 | Tarulli | 128/205.26 |
| 5,662,396 | A * | 9/1997 | Reeder et al. | 312/209 |
| 5,899,846 | A * | 5/1999 | Sternberg et al. | 600/21 |
| 6,062,215 | A * | 5/2000 | Leininger et al. | 128/202.12 |
| 6,434,766 | B1 * | 8/2002 | Beddawi | 5/18.1 |
| 6,497,231 | B1 * | 12/2002 | White | 128/202.12 |
| 7,402,137 | B2 * | 7/2008 | Lomask et al. | 600/504 |
| 7,479,103 | B2 * | 1/2009 | Ellen | 600/21 |
| 7,757,689 | B2 * | 7/2010 | Chang | 128/202.12 |
| 7,796,729 | B2 * | 9/2010 | O'Brien et al. | 378/65 |
| D651,714 | S * | 1/2012 | Dougherty | D24/164 |
| 2002/0189017 | A1 * | 12/2002 | Siepmann et al. | 5/658 |
| 2004/0007233 | A1 * | 1/2004 | Luppi | 128/205.26 |
| 2005/0045177 | A1 * | 3/2005 | Lacour | 128/202.12 |
| 2006/0020159 | A1 * | 1/2006 | Ellen | 600/21 |
| 2006/0041196 | A1 * | 2/2006 | Matthews et al. | 600/393 |
| 2007/0035217 | A1 * | 2/2007 | Bochner et al. | 312/209 |
| 2007/0151564 | A1 * | 7/2007 | Sadir et al. | 128/205.26 |
| 2008/0210234 | A1 * | 9/2008 | O'Brien et al. | 128/202.12 |
| 2010/0059059 | A1 * | 3/2010 | Evans | 128/205.26 |
| 2010/0198047 | A1 * | 8/2010 | Zagorchev et al. | 600/411 |
| 2010/0222638 | A1 * | 9/2010 | Chilton, III | 600/22 |

* cited by examiner

HYPERBARIC APPARATUS WITH STORAGE COMPARTMENT

BACKGROUND OF THE INVENTION

Hyperbaric or high pressure chambers are known to have important medical uses. A hyperbaric chamber is a chamber in which a pressure greater than ambient, over and above the range of pressure variation encountered in the course of normal weather fluctuations, can be achieved. U.S. Pat. No. 4,727,870 provides an example of such a hyperbaric chamber.

Perhaps the most vivid example of the use of hyperbaric chambers is in the treatment of divers suffering from nitrogen narcosis, commonly referred to as the "bends". It is well known that isolation of such a diver in a high-pressure oxygen atmosphere is one of the few known treatments for this often fatal or crippling condition.

Hyperbaric oxygen therapy (HBOT) involves treating a patient with 100% oxygen at greater-than-normal atmospheric pressures. The earth's atmosphere normally exerts approximately 15 pounds-per-square inch of pressure at sea level; that pressure defined as one Atmosphere Absolute (abbreviated as 1 ATA). In the ambient atmosphere, air contains approximately 20% oxygen and 80% nitrogen. While undergoing HBOT, pressure is increased two or three-fold (2 to 3 ATA) in an environment of 100% oxygen.

In addition to the diver bend treatment, medical researchers are continuing to experiment with HBOT in a hyperbaric chamber. Presently, there are many clinical applications for hyperbaric oxygen therapy, such as the treatment of traumatic injury, burns, infection, radiation injury, inflammation, edema, and for the treatment of poisoning (such as carbon monoxide poisoning).

SUMMARY

This invention relates to hyperbaric chambers and more particularly to a hyperbaric apparatus and system configured with a storage compartment, which provides storage of medical devices used for patient transport, such as a patient's gurney.

In many hospitals and locations where hyperbaric chambers are located, the treatment rooms are small and space is at a premium. Accordingly, the purpose of the hyperbaric apparatus, described subsequently in greater detail, is to provide a hyperbaric chamber configured with an open space for the storage of a patient transport device, such as a gurney or stretcher. The apparatus not only allows ease of transport of the patient into the hyperbaric chamber for treatment, but advantageously allows ease of storage of the patient's transport device by stowing the transport equipment in a special compartment beneath the chamber.

The hyperbaric apparatus described herein comprises a chamber for housing a patient and administering hyperbaric treatment, and a base configured with a storage compartment, the storage compartment comprised of a hollow cavity beneath the base large enough to store patient transport equipment, such as a gurney or a stretcher.

Also described herein is a hyperbaric system, comprising an integrated patient transport device and storage compartment. The moveable patient support platform can be optionally configured to engage with a reciprocal patient transport device.

The foregoing summary provides an exemplary overview of some aspects of the invention. It is not intended to be extensive, or absolutely require any key/critical elements of the invention.

BRIEF DESCRIPTION OF THE DRAWINGS

The detailed description is explained with reference to the accompanying figures. In the figures, the left-most digit(s) of a reference number identifies the figure in which the reference number first appears. The figures are not drawn to scale.

DETAILED DESCRIPTION

A hyperbaric apparatus comprising a storage compartment, configured for storage of a patient transport device, such as a gurney, is described herein.

The hyperbaric apparatus and system comprises a chamber for housing a patient and administration of hyperbaric therapy, a moveable patient support platform for receiving the patient and for transferring the patient into or out of the chamber, and a base comprising a storage compartment for stowing the patient's transport device and excluding it from the space surrounding the hyperbaric chamber, thereby freeing-up floor space surrounding the hyperbaric treatment area, whilst keeping the transport device close-at-hand for removal of the patient upon the conclusion of hyperbaric treatment.

DEFINITIONS

In describing and claiming the present invention, the following terminology will be used in accordance with the definitions set forth below.

Reference herein to "one embodiment", "an embodiment", or "another embodiment" herein, means that a particular feature, structure, operation, or characteristic described in connection with the embodiment, is included in at least one embodiment of the present invention. Thus, the appearances of such phrases or formulations herein are not necessarily all referring to the same embodiment. Furthermore, various particular features, structures, operations, or characteristics may be combined in any suitable manner in one or more embodiments.

As used herein, "hyperbaric" refers to increased pressure, that which is above-normal for the atmosphere.

As used herein, "hyperbaric chamber" refers to a pressure-safe chamber used to induce an increase in ambient pressure therein, in which the pressure is above normal for the atmosphere, for the administration of hyperbaric treatment or therapy.

As used herein, "chamber" refers to space that is enclosed or compartmentalized, suitable for housing a patient and for inducing hyperbaric conditions.

As used herein, "compartment" refers to a separate division or section, such as a separate section of an apparatus.

As used herein, "patient transport device" and "patient transport equipment" refer to mobile means of transporting a patient or subject, such as a gurney, a stretcher, a wheel-chair, a hospital bed, and the like.

Hyperbaric Apparatus with Storage Compartment

Figure 1:
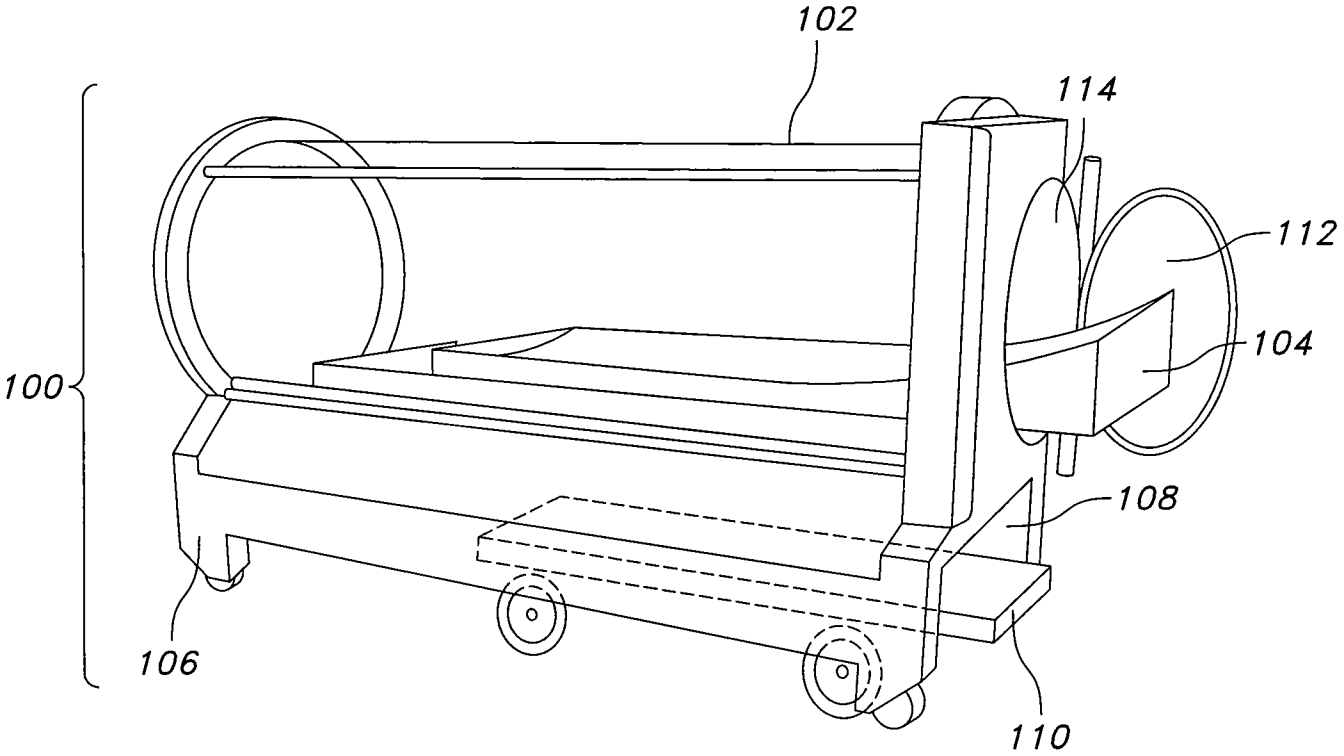
FIG. 1 shows a perspective drawing of the hyperbaric apparatus 100 of the present invention.

Described herein and shown in one exemplary implementation in FIG. 1 is a hyperbaric apparatus 100 that may include a hyperbaric chamber 102, a moveable-patient-support platform 104, a base 106, and storage compartment 108. Hyperbaric chamber 102 houses a patient for administration of hyperbaric therapy. Moveable patient-support platform 104 receives a patient and transfers the patient into or out of the chamber 102. Base 106 includes a storage compartment 108 for storage of a patient's transport equipment 110, such as a gurney.

In one embodiment, chamber 102 is a hyperbaric chamber comprised of a cylindrically shaped housing unit that is sealed at one end and configured with a pressure-safe chamber door 112 at the opposite end.

In another embodiment, chamber 102 is transparent or partially-transparent as to allow visual inspection of the chamber interior. A chamber door 112 is moveable between an open and closed position and defines an entry point 114 through which a patient is transferred into or out of the interior of chamber 102.

In one embodiment, chamber door 112 is configured with a locking mechanism, such as a latch, that can be manually or remotely operated. Chamber 102 provides an environment for hyperbaric oxygen therapy or treatment; up to 100% oxygen and pressure exceeding ambient pressure In one embodiment, moveable-patient-support platform 104 supports a patient in a supine or partially-elevated position and is configured such that platform 104 slides horizontally in or out of the chamber. Moveable-patient-support platform 104 can extend or retract by an automated or a manual process. Moveable-patient-support platform 104 can be constructed of any materials suitable for supporting a patient, preferably in a supine or partially-elevated position. Moveable-patient-support platform 104 can be a congruent platen or incongruent, such as segmented, to allow partial-elevation, such as elevation of a portion of the platform corresponding to a patient's lower extremities and/or to a patient's head and torso.

In another embodiment, moveable-patient-support platform 104 is configured with a covering, such as a mat, mattress, or other thick layer of material, whether synthetic or natural, thereby providing comfort for a patient lying thereon. Ideally, the covering is removable so that the surface can be cleaned and sanitized, either by decontamination of the covering or by the placement of a new covering on the patient support platform.

Figure 2:
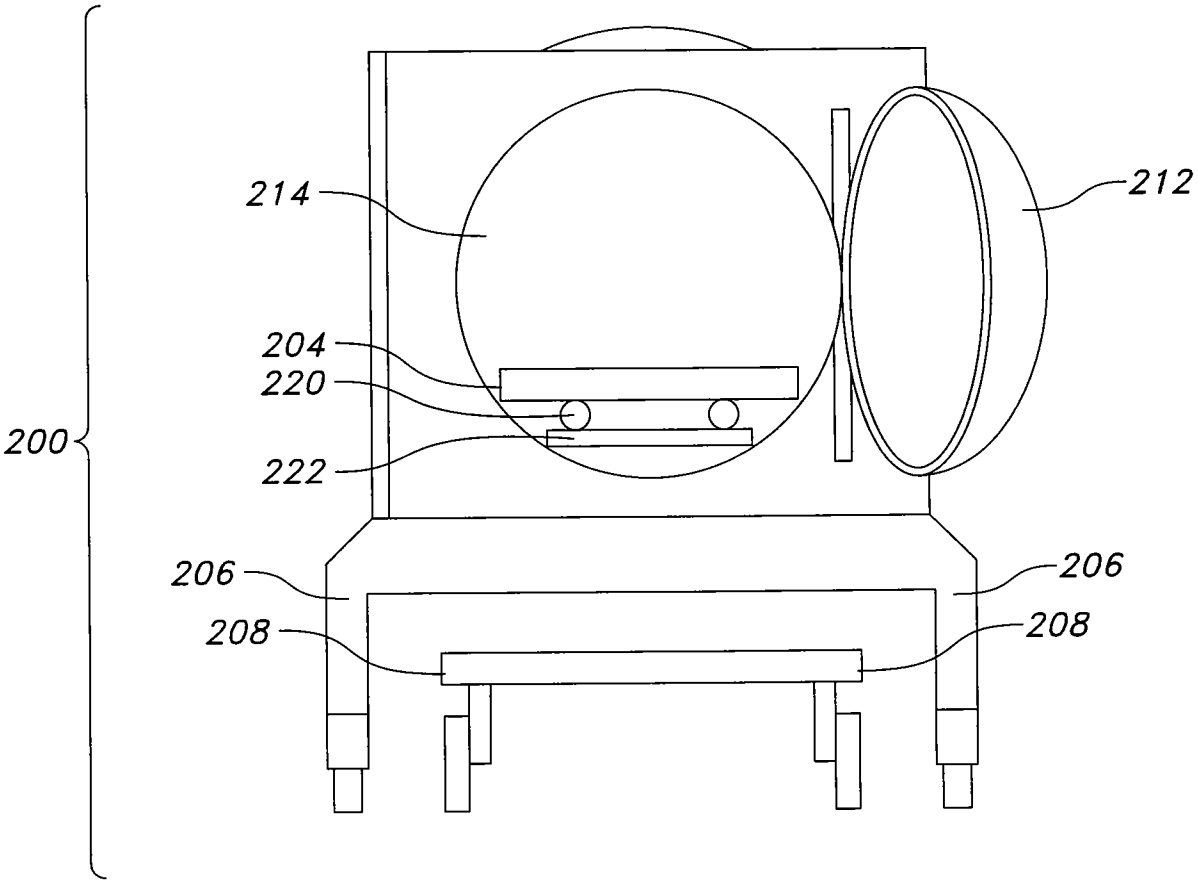
FIG. 2 shows a front end view of the hyperbaric apparatus 100 with a patient transport device stowed in the storage compartment.

In one embodiment, depicted in FIG. 2, a moveable-patient-support platform 204 slides along an interconnected rail system 220 mounted to the underside of the patient support platform 204 and to a foundational axis 222 on the interior of chamber 202.

Figure 3:
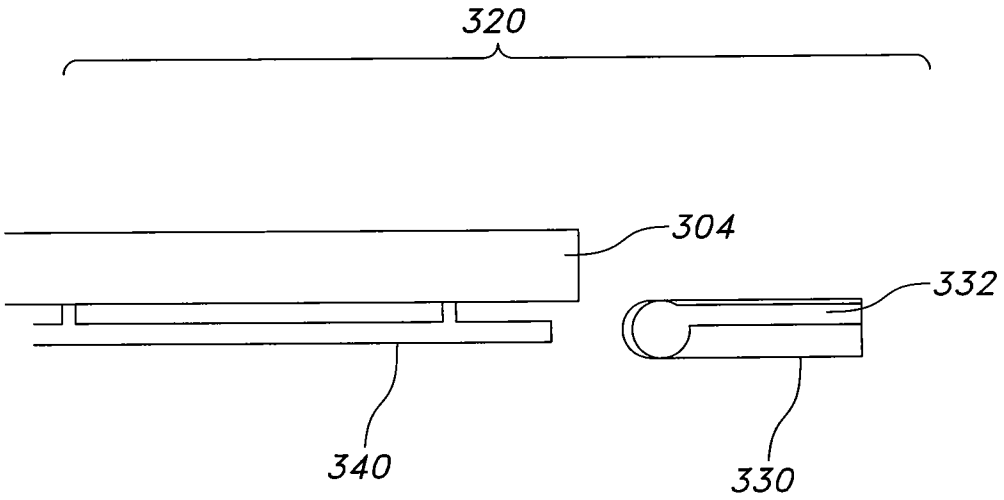
FIG. 3 shows one implementation of a rail system of one embodiment of the present invention.

In one embodiment, depicted in FIG. 3, an interconnected rail system 320 includes a hollow rod 330 with a thin opening 332 along the length of the rod 330 and serves as an outer rod for a rail system 320. In another embodiment, an inner rod 340 is attached to the posterior portion of patient-support platform 304 and engages a hollow-outer rod 330. The benefit of such a rail system is that a corresponding rail system can likewise be configured on a patient transport device, thereby allowing the patient support platform to engage/disengage between the patient transport device and the hyperbaric chamber. It should be understood, however, that other retractable means could be provided as would be identifiable by those of ordinary skill in the art upon having the benefit of this disclosure.

Referring back to FIG. 1, in one embodiment, base 106 of apparatus 100 is commensurate in length with the length of chamber 102. In another embodiment, base 106 is secured to, and supports, chamber 102. Base 106 can be comprised of any suitable materials for supporting the weight of chamber 102. In one embodiment, base 106 has an overall shape being rectangular, with a hollow cavity in the belly of the base that comprises storage compartment 108. In another embodiment, base 106 includes support members, such as columns or legs, which support chamber 102 while anchoring apparatus 100 to the floor. In yet another embodiment, base 106 of apparatus 100 can be configured with casters so to allow portability or movement of apparatus 100.

In another embodiment, base 106 houses additional features (not shown in Figures) such as patient monitoring and support interfaces that allow monitoring of the patient undergoing hyperbaric treatment. Additional features include a control panel for controlling pressure and air flow within the chamber, and a communication port that allows for communication between an operator of the apparatus and the patient residing inside the chamber.

In one embodiment, storage compartment 108 comprises a hollow space or cavity within the base 106 of the apparatus 100. In one embodiment, storage compartment 108 has a length commensurate with the length of the base 106. In another embodiment, storage compartment 108 has a height commensurate with the height of base 106. The size of storage compartment 108 may vary. In one embodiment, the dimensions of the hollow space or cavity allow for storage of standard-sized patient-transport equipment 110, such as a gurney or stretcher.

Turning to FIG. 2 a hyperbaric apparatus 200 is shown with a patient transport device 210 stowed in storage compartment 208. Because the patient transport device 210 is neatly stowed in the storage compartment 208, the immediate area surrounding apparatus 200 is clear and free of obstruction. This is especially helpful in a small space, where much of the room may be taken up by the chamber itself or other patient monitoring equipment. Thus, the space immediately surrounding the apparatus 200 and in closest proximity to the patient undergoing treatment can instead freely be occupied by medical personnel.

In one embodiment, the patient transport device shown stowed in the storage compartment of the apparatus in FIGS. 1 and 2 is a standard hospital gurney or stretcher used for transporting a patient, such as from a hospital bed to a hyperbaric chamber for hyperbaric treatment. In one embodiment, the gurney can be adjustable in height, whether by a manual process or an automated process, such as a hydraulic lift system.

Figure 4:
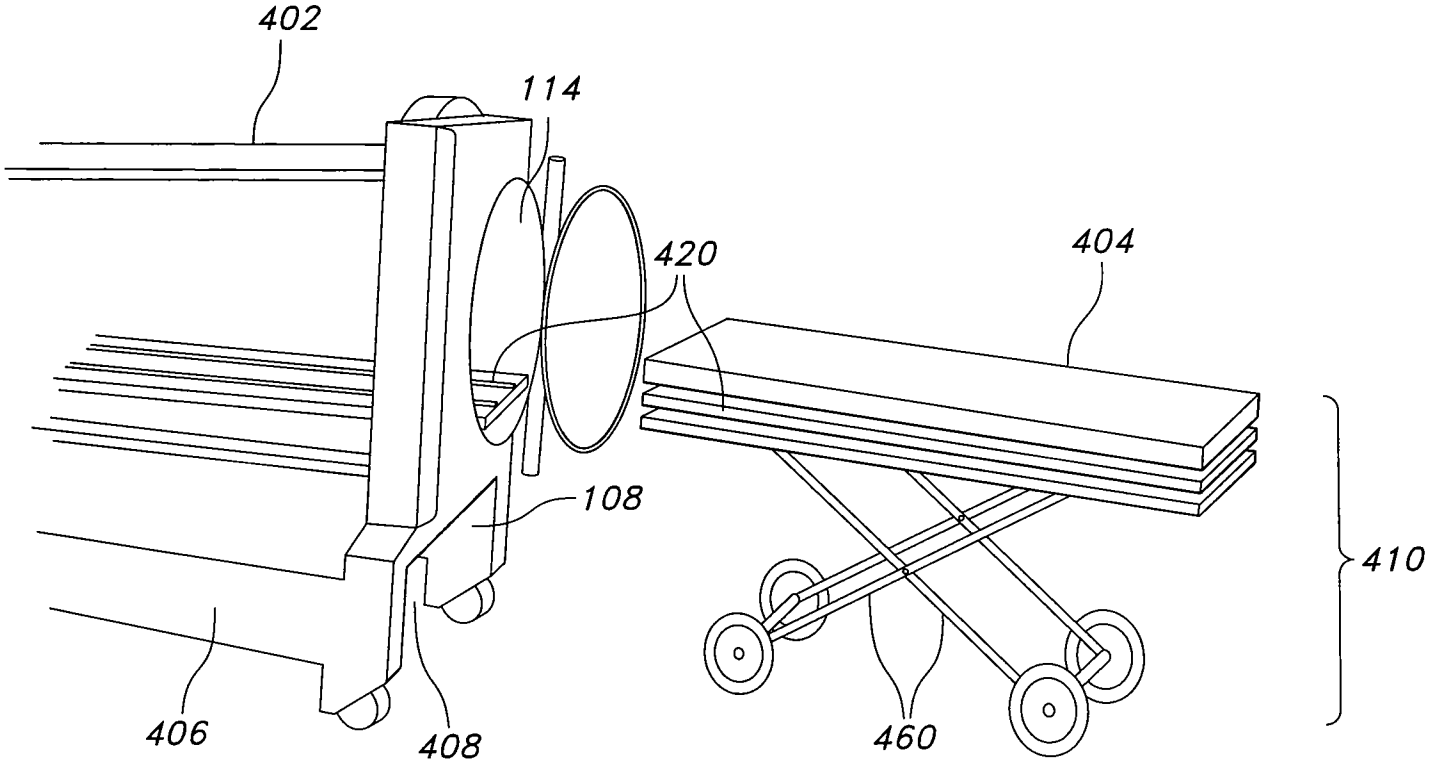
FIG. 4 shows an integrated hyperbaric apparatus and patient transport system of one embodiment of the present invention.

In another embodiment, shown in FIG. 4, an integrated-patient-transport device 410 comprises the patient support platform 404 reversibly engaged to the surface of a wheeled carriage 460. In one embodiment, the patient-support platform 404 is reversibly engaged to the wheeled carriage 460 by the rail system 420 as described above in relation to FIG. 3. Thus, a patient received on integrated-patient-transport device 410 can be transferred to the chamber 402 by simply engaging rail system 420, thus allowing the patient support platform 404 to slide across the surface of the wheeled carriage 460 and into the chamber 402. Once the patient support platform 404 has deposited the patient into the chamber 402 and the platform 404 is securely in position, the wheeled carriage 460 can be stowed in the storage compartment 408 of the base 406.

Integrated Hyperbaric Chamber and Patient Transport System

Also disclosed herein is an integrated hyperbaric chamber and patient transport system for use in hyperbaric treatment therapy, the integrated system comprising means of transporting a patient to a hyperbaric chamber and means of storing the patient transport within the hyperbaric chamber.

In one embodiment, the means of transporting a patient comprises a patient transport device as described in relation to FIG. 4 whereby a patient support platform is configured to reciprocally engage both the patient transport device and the interior of the hyperbaric chamber.

In another embodiment, the means of storing the patient transport device comprises a storage compartment within the hyperbaric chamber, whereby the patient transport device can be stored while not in use transporting a patient to or from the hyperbaric chamber for hyperbaric treatment.

The described embodiments are to be considered in all respects only as exemplary and not restrictive. The scope of the invention is, therefore, indicated by the subjoined claims rather by the foregoing description. All changes which come within the meaning and range of equivalency of the claims are to be embraced within their scope.

The invention claimed is:

1. A hyperbaric apparatus, comprising:

a hyperbaric chamber configured to provide an increase in pressure in a range of two to three atmospheres (ATA) in an environment of up to 100% oxygen, the hyperbaric chamber comprising: (i) a patient-support platform configured to permit a patient to be placed thereon in a horizontal position, and (ii) a base comprising a storage compartment, wherein the storage compartment is configured to store a patient-transport device, wherein the patient-transport device includes a rail system configured to engage the patient-support platform adapted to support a patient in a horizontal position and a wheeled carriage, adapted to allow the patient-transport device to be moved to different locations;

wherein the wheeled carriage comprises wheels and a frame adapted to raise and lower the patient-support platform;

wherein the storage compartment comprises an inverted, generally U-shaped hollow cavity having no bottom portion and having dimensions so as to permit entry and exit, of the patient-transport device when the frame is in a lowered position and configured to receive and straddle the patient transport device so as to provide unobstructed-wheeled movement of the patient-transport device so that the patient transport device may be wheeled into and out of the hollow cavity;

and wherein the patient-support platform comprises a rail system configured to mate with the rail system on the patient transport device, thereby allowing the patient support-platform to engage/disengage between the patient transport device and the hyperbaric chamber.

2. A method of transporting a patient to a hyperbaric apparatus, comprising:

providing a hyperbaric chamber comprising a patient-support platform configured to permit a patient to be placed thereon in a horizontal position and a base comprising a storage compartment, wherein the storage compartment comprises an inverted, generally U-shaped hollow cavity having no bottom portion and having dimensions so as to receive and straddle a patient-transport device, wherein the patient transport device comprises a rail system configured to engage the patient-support platform adapted to support a patient in a horizontal position and a wheeled carriage, the wheeled carriage comprising wheels and a frame adapted to raise and lower the patient-support platform and to allow the patient-transport device to be moved to different locations, so as to provide unobstructed-wheeled movement of the patient transport device so that the patient transport device may be wheeled into and out of the hollow cavity when the frame is in a lowered position, and to store the patient transport device therein;

transferring a patient from the patient-transport device to lay on top of the patient-support platform of the hyperbaric chamber; wherein the patient-support platform of the hyperbaric chamber comprises a rail system configured to mate with the rail system on the patient transport device, wherein transferring the patient includes moving the patient from the patient transport device to the hyperbaric chamber by engaging the rail systems of the hyperbaric chamber and patient transport device; glowering frame of the patient transfer device; wheeling the patient supporting device into the storage compartment; and storing the patient supporting device in the storage compartment for a period of time.

3. The method of claim 2, wherein the hyperbaric chamber is configured to provide an increase in pressure in a range of two to three atmospheres (ATA) in an environment of up to 100% oxygen.

* * * * *